US005878705A

United States Patent [19]

Maas

[11] Patent Number: 5,878,705

[45] Date of Patent: Mar. 9, 1999

[54] DEVICE FOR THE OPTIONAL ACTUATION OF AT LEAST ONE GAS EXCHANGE VALVE

[75] Inventor: Gerhard Maas, Herzogenaurach, Germany

[73] Assignee: INA Wälzlager Schaeffler OHG, Herzogenaurach, Germany

[21] Appl. No.: 290

[22] PCT Filed: May 2, 1996

[86] PCT No.: PCT/EP96/01809

§ 371 Date: Jan. 26, 1998

§ 102(e) Date: Jan. 26, 1998

[87] PCT Pub. No.: WO97/06357

PCT Pub. Date: Feb. 20, 1997

[30] Foreign Application Priority Data

Aug. 3, 1995 [DE] Germany ..... 19528505.0

[51] Int. Cl.[6] ..... F01L 13/00; F01L 1/14

[52] U.S. Cl. ..... 123/90.16; 123/90.19; 123/198 F

[58] Field of Search ..... 123/90.15, 90.16, 123/90.17, 90.19, 90.48, 90.49, 90.55, 198 F

[56] References Cited

U.S. PATENT DOCUMENTS

| | | | |
|---|---|---|---|
| 4,741,298 | 5/1988 | Rhoads | 123/90.5 |
| 5,090,364 | 2/1992 | McCarroll et al. | 123/90.16 |
| 5,158,048 | 10/1992 | Siemens | 123/90.16 |
| 5,320,082 | 6/1994 | Murata et al. | 123/90.16 |
| 5,345,904 | 9/1994 | Dopson et al. | 123/90.16 |

FOREIGN PATENT DOCUMENTS

| | | | |
|---|---|---|---|
| A 35 43 537 | 4/1986 | Germany . | |
| 4206166 | 9/1992 | Germany | 123/90.16 |
| A 43 14 619 | 11/1994 | Germany . | |
| 43 24 987 A1 | 2/1995 | Germany . | |

OTHER PUBLICATIONS

Der Hydraulik–Trainer, Lehr–und Informationsbuch über die Hydraulik, 2 Ed. , 11.80, G.L. Rexroth GmbH, Lohr A. Main, 1978, p. 129–135.

Backe, W.: Grundlagen der Ölhydraulik, 5. Ed., RWTH, Aachen, 1986, p. 2–39 to 2–41.

*Primary Examiner*—Weilun Lo

*Attorney, Agent, or Firm*—Henry M. Feiereisen

[57] ABSTRACT

Apparatus (1) for selective actuation of at least one gas exchange valve includes two members (2, 3) which can be selectively coupled through radially moveable coupling element (7), thereby facilitating the return flow of the hydraulic fluid acting upon the coupling element (7) in the direction of displacement especially at low ambient temperatures of the internal combustion engine and thus highly viscous hydraulic fluid. According to the invention, a relief channel (20) with an orifice plate (18) is installed in the return channel. With an orifice plate (18) of this type, the volume flow rate of the hydraulic fluid is largely independent of the viscosity, so that the coupling element (7) can be reset sufficiently fast even at low ambient temperatures.

10 Claims, 3 Drawing Sheets

DEVICE FOR THE OPTIONAL ACTUATION OF AT LEAST ONE GAS EXCHANGE VALVE

FIELD OF THE INVENTION

The invention relates to an apparatus for selective actuation of at least one gas exchange valve with a switchable cam follower which is operatively connected between at least one cam of a camshaft and the gas exchange valve, or with a support device for a cam follower, including at least two members which can be displaced relative to each other and coupled to one another, with the first member communicating with the cam of great lift in order to provide a great valve lift, wherein the cam follower or the support device includes a coupling element which can be moved in at least one displacement direction through hydraulic fluid for selectively connecting the two members such as to transmit the great cam lift to the gas exchange valve, and wherein at least one channel extends in the cam follower or the support device for supplying and draining the hydraulic fluid.

BACKGROUND OF THE INVENTION

An apparatus of this type is described, for example, in DE-A 42 06 166. There, the two members are coupled through pistons which are arranged along the circumference and which can be moved radially in the coupling direction from the outside towards the inside via hydraulic fluid in opposition to the biasing force of an annular spring. For decoupling, the annular spring moves the respective pistons radially outwardly, counteracting the hydraulic pressure behind an annular surface separating the two members. Disadvantageously, however, the apparatus described in the above referenced patent document exhibits problems in conjunction with switching times, in particular at low temperatures when the hydraulic fluid has a high viscosity. If the internal combustion engine is started at relatively low ambient temperatures, the viscosity of the hydraulic fluid can be so high that the spring unit cannot move the piston into the decoupled position during the time available for the decoupling process (base circle). Such switching problems occur in particular when the internal combustion engine is operated not only at low ambient temperatures, but-after starting-also in a speed range above the idle speed, for example at partial load or even full load.

OBJECT OF THE INVENTION

It is therefore an object of the invention to provide an apparatus of the afore-stated type which obviates these drawbacks and which employs simple measures to eliminate problems associated with the switching times, in particular at a low ambient temperature of the internal combustion engine when the hydraulic fluid is highly viscous.

SUMMARY OF THE INVENTION

The object of the invention is solved by associating with the return channel for the hydraulic fluid an orifice plate or an orifice plate-like bore. In another embodiment of the invention, the orifice plate has the form of a standard orifice plate or standard-type orifice plate with sharp edges, wherein the flanks of the orifice plate enclose an angle of about 60° to 90° and open in the reverse flow direction. In another preferred embodiment, the return channel for the hydraulic fluid can include a relief channel for at least a portion of the returning hydraulic fluid, wherein the orifice plate is disposed in the relief channel. By using this type of orifice plate which is described, for example, in German Industrial Standard DIN 1952, the volume flow rate of the hydraulic fluid becomes essentially independent of the viscosity. In other words, the invention eliminates the afore-described timing problems which occur especially at low ambient temperatures of the internal combustion engine. With the application of an orifice plate of this type in the reverse flow direction of the hydraulic fluid, the quantity of returning hydraulic fluid per unit of time, i.e. the flow rate, is expected to be constant over all ranges in temperature and viscosity. This problem is discussed extensively in the published lecture notes from the lecture entitled "Fundamentals of Oil Hydraulics" by Prof. Dr. Ing. W. Backé, $6^{th}$ edition 1986, RWTH Aachen (pages 2–40 ff. and 2–14 and following pages). The orifice effect utilized in the present invention is based on the observation that the flow starts to become turbulent at quite low Reynolds numbers if the cross section in the flow direction undergoes an abrupt change. The cross section can also be changed in this manner by providing, for example, a laser-drilled hole which has a unique neck profile, or with a similar arrangement.

It should be noted that similar orifice plate designs can also be applied to other engine parts, such as to hydraulic conduits for hydraulic cam lifters. These hydraulic cam lifters, too, can be expected to exhibit timing problems at low ambient temperatures due to the high viscosity of the hydraulic fluid, in particular, when the internal combustion engine is started for the first time, and restarted again.

In implementing the invention, the return channel for the hydraulic fluid is also used as the supply channel for the hydraulic fluid. This measure eliminates the need for additional and separate complex conduits and enables the residual quantity of hydraulic fluid to be returned to the supply conduit when the hydraulic pressure decreases.

A simple design and construction of the relief channel can be realized when forming the relief channel by sections of a receiving bore for the respective coupling element. Here, the relief channel is part of the receiving bore for the respective piston, thereby obviating the need for a separate and expensive relief channel in the apparatus.

In accordance with another embodiment of the invention, the apparatus can be configured in the form of a switchable cup-shaped tappet, the stop element of which for the piston forming in the displacement bore an orifice at the same time. The invention can be applied, however, to any type of switchable valve actuators, for example support elements, switchable rocker lever systems or finger lever systems, switchable valve actuation bridges and the like.

A further feature of the invention includes provision of at least one compression spring for applying a force to urge the coupling element in the further displacement direction. As a result of providing this compression spring, the provision of only one single-loop hydraulic system is necessary, whereby it is also feasible to provide a hydraulic actuation to urge the coupling element in the opposite displacement direction. It should also be mentioned that the coupling element can be moved in the further displacement direction by magnetic, electromagnetic, mechanical or similar means.

The invention is not restricted solely to the features of the claims. It is also contemplated to combine several individual features of the claims and to combine features in the claims with subject matter disclosed in the specification.

BRIEF DESCRIPTION OF THE DRAWINGS

The invention is described hereinafter in greater detail with reference to the drawing, in which.

DETAILED DESCRIPTION OF THE DRAWINGS

Figure 1:
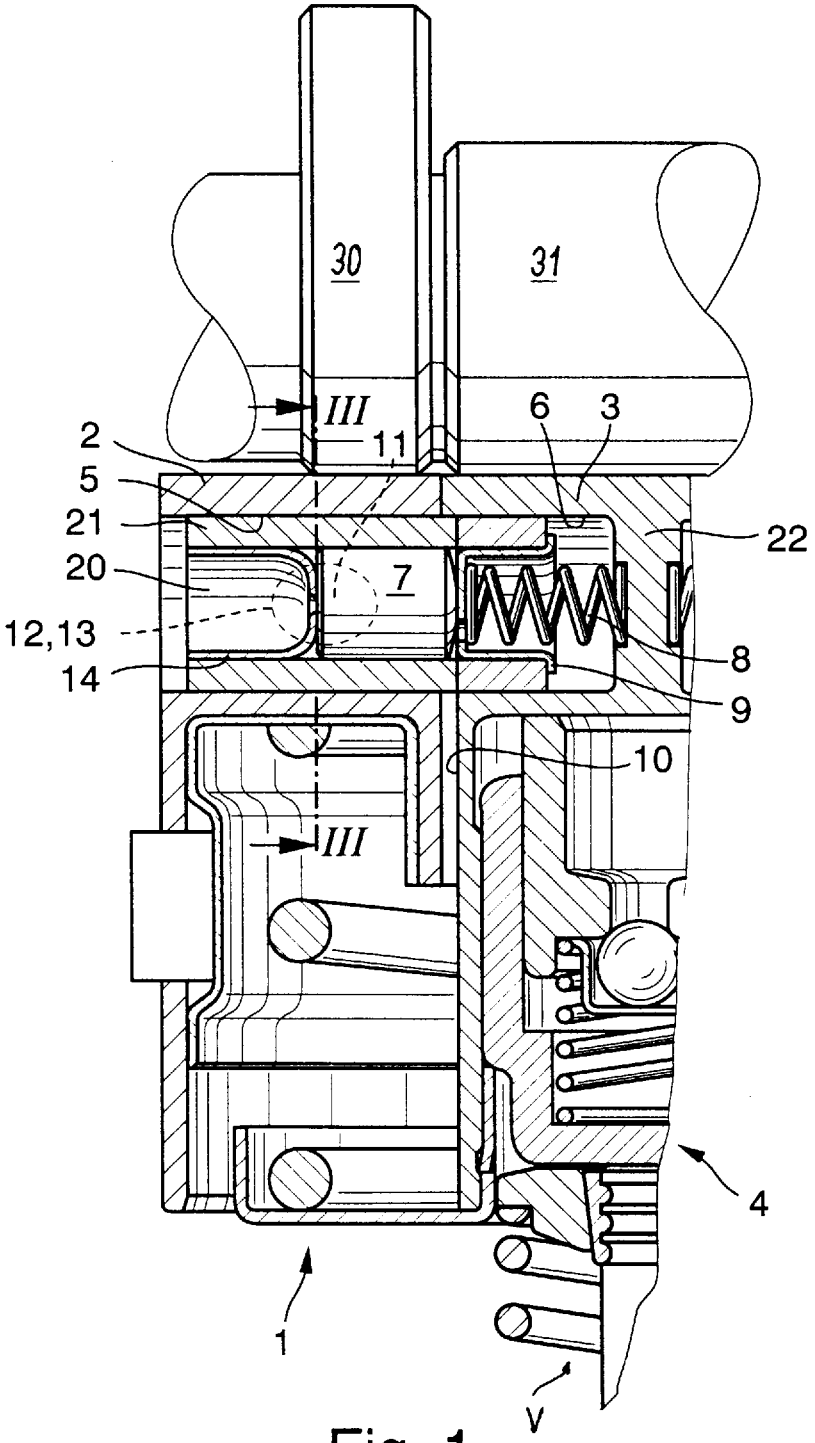
FIG. 1 is a partial longitudinal section of an apparatus according to the invention.

FIG. 1 shows an apparatus 1 in the form of a switchable cup-shaped tappet. The apparatus 1 will hereinafter not be described in detail, since the overall design is well known in the art (see, for example, DE-A 43 14 619). The apparatus 1 includes a first circular ring shaped member 2 which is acted upon by a cam 30 of great lift. The circular ring shaped member 2 surrounds a at circular member 3 which is acted upon by a cam 31 for transmitting a small or zero lift. Both members 2, 3 can move axially relative to each other, with the circular member 3 having incorporated therein a clearance compensating element 4 and communicating in the lifting direction at least indirectly with a gas exchange valve generally designated by reference character V. A first receiving bore 5 is located in the bottom of the annular member 2 and is aligned in the base circle of the control cams 30, 31 with a further receiving bore 6 in the circular member with two cylinders 21, 22 being fitted in the receiving bores 5, 6.

A longitudinally displaceable coupling element 7, here in the form of a piston, is positioned in the first receiving bore 5. The piston 7 is biased in the decoupling direction by the force of a compression spring 8 which is displaced from the center radially outwardly and acts upon a sliding sleeve 9 which is received in and secured to the cylinder 22. When the sliding sleeve 9 and the compression spring 8 are in the end position, as is illustrated here, the two members 2, 3 are decoupled, because the aforementioned members 9, 8 have forced the coupling element 7 to shift completely into the first receiving bore 5, i.e. the coupling element 7 no longer projects over an annular surface 10 between the members 2, 3.

Figure 2:
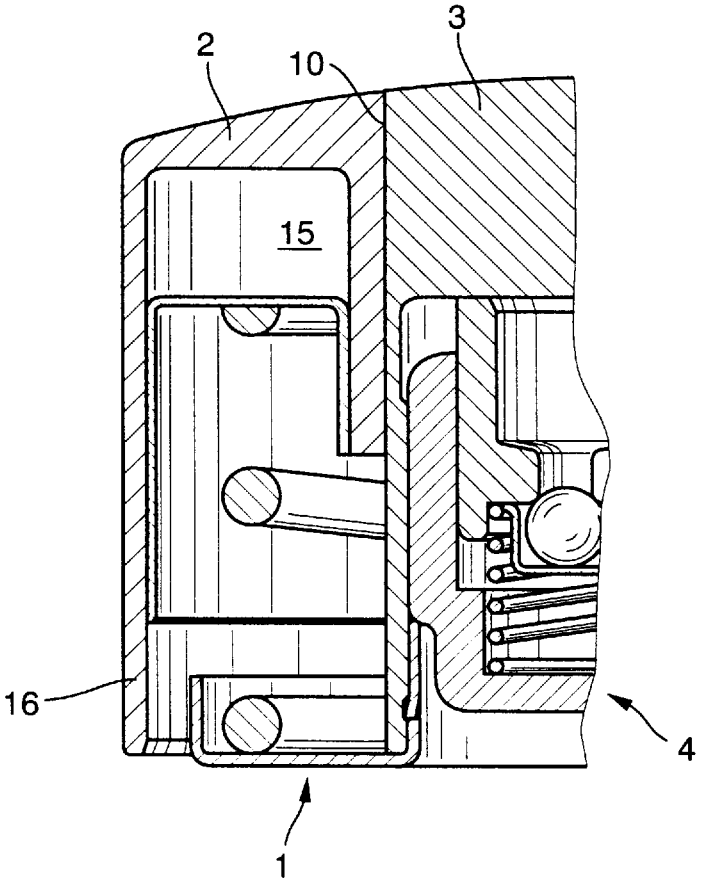
FIG. 2 is a partial longitudinal section of FIG. 1 rotated about 90°.
Figure 3:
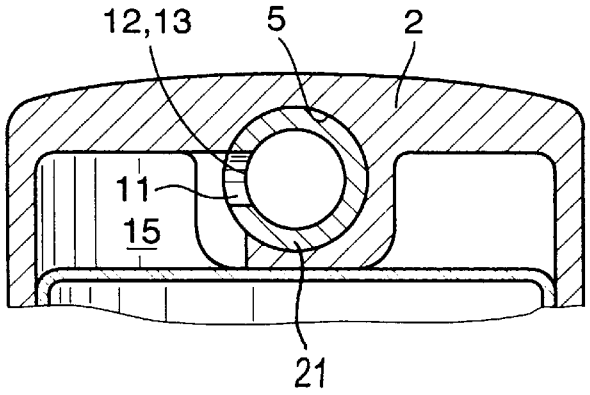
FIG. 3 is a partial longitudinal section taken along the line III—III of FIG. 1.
Figure 4:
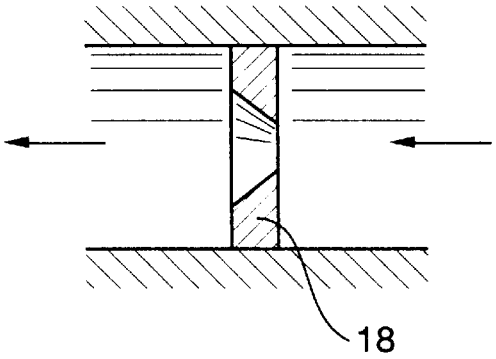
FIG. 4 is a view of the standard orifice plate.

In the opposite direction of displacement, i.e. radially inwardly, the hydraulic pressure can move the coupling element 7 so as to couple the two members 2, 3 to one another. For this purpose, the annular member 2 is provided with a channel 11 (see also FIG. 3) having an opening 13 which intersects a bore wall 12. The channel 11 for supply of the hydraulic fluid is designed to simultaneously operate as drain channel for the hydraulic fluid. Furthermore, the receiving bore 5 is bounded radially outwards by a sleeve 14 which is received in the cylinder 21. This sleeve 14, on the one hand, limits the travel of the coupling element 7 and, on the other hand, prevents an unwanted discharge of hydraulic fluid which is directed through the channel 11 between the sleeve 14 and the coupling element 7. Consequently, when the channel 11 is acted upon by hydraulic fluid, the coupling element 7 moves partly radially inwardly into the receiving bore 6 in opposition to the force of the compression spring 8. In this state, the two members 2, 3 are coupled and lift is transmitted from the cam 30 which acts upon the member 2, with the hydraulic fluid flowing from an annular space 15 (see FIGS. 2 and 3) into the channel 11. The annular space 15 also forms a reservoir for the hydraulic fluid which is supplied via a supply bore (not shown) extending through an outer skirt of the member 2.

Figure 5:
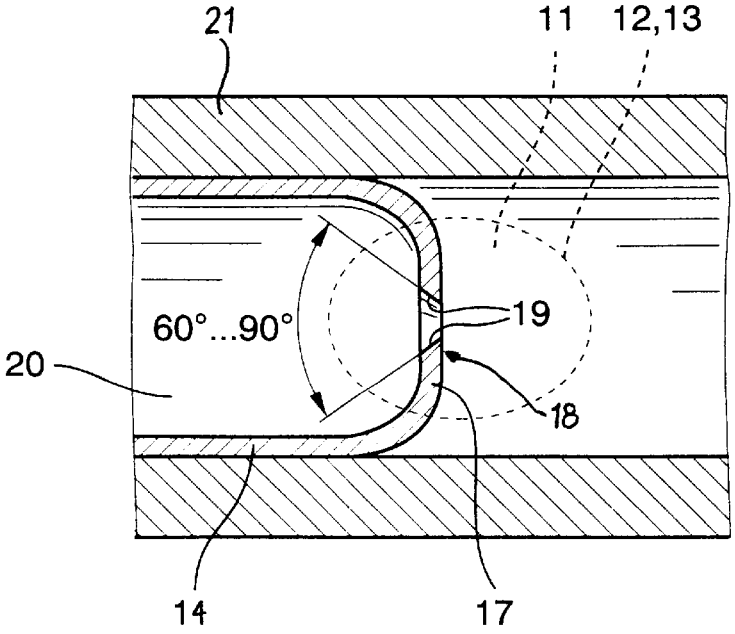
FIG. 5 is a partial view of the receiving bore for the coupling element in the region of the orifice plate.

According to the invention, the sleeve 14 has a bottom 17 (see, in particular, FIG. 5) in the form of an orifice plate 18. The orifice plate 18 includes flanks 19 forming an angle of about 60° to 90° therebetween, with edge regions of the flanks 19 having sharp edges. This orifice plate 18 forms radially outwards in the receiving bore 5 a relief channel 20 for hydraulic fluid.

As mentioned in the introductory part of the specification, timing problems are experienced during reset of the coupling element 7 by the compression spring 8 in the first receiving bore 5, especially in connection with highly viscous oil caused at low ambient temperatures. These timing problems are now eliminated by measures of the invention in that the reset time of the coupling element 7 is substantially independent of the viscosity. The orifice plate 18 (for example a standard orifice plate or constructed similar to a standard-type orifice plate) causes the volume flow rate of the returning hydraulic fluid to become essentially independent of the viscosity. A small quantity of hydraulic fluid may still escape through the relief channel 20; however, this is acceptable in view of the advantages attainable with the present invention. If necessary, the output of the hydraulic pump may be slightly increased.

What is claimed is:

1. Apparatus (1) for selective actuation of a gas exchange valve with a switchable cam follower which is operatively connected between at least one cam of a camshaft and the gas exchange valve, said cam follower including first and second members (2, 3) displaceable relative to each other and capable of being coupled to one another, with the first member (2) communicating with a cam for effecting a valve lift, wherein there is provided in the cam follower a coupling element (7) which can be moved in at least one displacement direction by hydraulic fluid for selectively connecting the first and second members (2, 3) for the purpose of transmitting the cam lift to the gas exchange valve, and wherein at least one channel (11) extends in the cam follower to supply and return the hydraulic fluid, characterized in that an orifice plate (18) is associated with the channel (11) for returning the hydraulic fluid, with the channel (11) being provided with a relief channel (20) for at least a portion of the returning hydraulic fluid, with the relief channel (20) being formed by members of a receiving bore (5) for the respective coupling element (7), wherein the orifice plate (18) is incorporated in the relief channel (20).

2. Apparatus according to claim 1, characterized in that the orifice plate (18) has the form of a sharp-edged standard orifice plate, whose flanks (19) enclose an angle of about 60° to 90° and open in the reverse flow direction.

3. Apparatus according to claim 1, characterized in that the coupling element (7) is acted upon by the force of at least one compression spring (8) for displacement in a direction for disconnecting the first and second members.

4. Apparatus according to claim 1, with the cam follower in the form of a cup-shaped tappet having the first member (2) of circular ring shape and surrounding the second member (3) of circular shape which is acted upon by a cam of smaller lift, including no lift, compared to the cam acting on the first member, with the coupling element (7) being configured in the form of at least one piston displaceable in the tappet and extending in the disengaged state in a receiving bore (5) of the first member (2), and is acted upon by hydraulic fluid from the outside to effect coupling, and wherein the receiving bore (5) is bounded radially outwards by a sleeve (14) with hydraulic fluid capable of flowing between the sleeve (14) and the piston through an opening (13) of the channel (11), characterized in that the orifice plate (18) is disposed in the sleeve (14).

5. Apparatus according to claim 4, characterized in that the orifice plate (18) is so designed as to limit travel of the piston.

6. Apparatus for selective actuation of a gas exchange valve, comprising:

a first member acted upon by a first cam;

a second member acted upon by a second cam of smaller lift than said first cam, said first and second members being displaceable relative to each other;

a coupling element capable of connecting the first and second members with each other;

fluid passageway means having a passageway for conducting a hydraulic fluid to the coupling element to effect a displacement of the coupling element at least in one direction thereby connecting the first and second members and effect transmission of the lift of the first cam upon the gas exchange valve, said fluid passageway means including an orifice plate for bleeding hydraulic fluid during return flow of hydraulic fluid through the passageway and a relief channel fluidly connected to the passageway via the orifice plate for bleeding at least a portion of hydraulic fluid during return flow through the passageway, wherein the first member is formed with a receiving bore for accommodating the coupling element and defining the relief channel.

7. The apparatus of claim 6 wherein the orifice plate has the form of a sharp-edged standard orifice plate and is defined by flanks which enclose an angle of about 60° to 90° and are so configured as to expand in a direction away from the passageway.

8. The apparatus of claim 6, and further comprising a spring member for so loading the coupling element as to seek a disengagement between the first and second members.

9. The apparatus of claim 6 wherein the first member is of circular ring shape, the second member is of circular shape, said first member surrounding the second member and having a receiving bore, said fluid passageway means including a sleeve fitted in the receiving bore and having a portion formed by the orifice plate, with the passageway extending between the sleeve and the coupling element.

10. The apparatus of claim 6 wherein the orifice plate is so designed as to limit travel of the coupling element.

* * * * *